US010995289B2

(12) United States Patent
Zhou

(10) Patent No.: US 10,995,289 B2
(45) Date of Patent: May 4, 2021

(54) GASOLINE PRODUCT CONTAINING COMBUSTION IMPROVER AND MANUFACTURING METHOD THEREFOR

(71) Applicant: Zhou (Beijing) Automotive Technology Co., Ltd., Beijing (CN)

(72) Inventor: Xiangjin Zhou, Beijing (CN)

(73) Assignee: ZHOU (BEIJING) AUTOMOTIVE TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/524,303

(22) PCT Filed: Nov. 5, 2015

(86) PCT No.: PCT/CN2015/093928
§ 371 (c)(1),
(2) Date: May 4, 2017

(87) PCT Pub. No.: WO2016/070831
PCT Pub. Date: May 12, 2016

(65) Prior Publication Data

US 2017/0335212 A1 Nov. 23, 2017

(30) Foreign Application Priority Data

Nov. 5, 2014 (CN) ..... 201410614564.4

(51) Int. Cl.

| | |
|---|---|
| ***C10L 1/14*** | (2006.01) |
| ***C10L 1/19*** | (2006.01) |
| ***C10L 1/185*** | (2006.01) |
| ***C10L 1/08*** | (2006.01) |
| ***C10L 1/22*** | (2006.01) |
| ***C10L 1/12*** | (2006.01) |

(52) U.S. Cl.
CPC ..... *C10L 1/08* (2013.01); *C10L 1/1266* (2013.01); *C10L 1/185* (2013.01); *C10L 1/19* (2013.01); *C10L 1/22* (2013.01); *C10L 2200/029* (2013.01); *C10L 2200/0259* (2013.01); *C10L 2270/023* (2013.01)

(58) Field of Classification Search
CPC ..... C10L 1/14; C10L 1/1852
See application file for complete search history.

(56) References Cited

U.S. PATENT DOCUMENTS

| | | | | |
|---|---|---|---|---|
| 4,892,561 | A * | 1/1990 | Levine | C10L 1/026 44/322 |
| 7,976,591 | B2 * | 7/2011 | Paggi | C10L 10/10 44/428 |
| 10,072,558 | B2 * | 9/2018 | Zhou | F02D 13/0203 |
| 2009/0151236 | A1 * | 6/2009 | Shibata | C10L 1/1824 44/447 |
| 2010/0319243 | A1 | 12/2010 | Aradi et al. | |
| 2011/0209686 | A1 * | 9/2011 | McCann | F02M 53/06 123/304 |

FOREIGN PATENT DOCUMENTS

| | | | | |
|---|---|---|---|---|
| CN | WO2001092442 | A1 * | 12/2001 | C10L 1/04 |
| CN | 1405281 | A | 3/2003 | |
| CN | 1405281 | A * | 3/2003 | |
| CN | 1950489 | B | 10/2010 | |
| CN | 102027225 | A | 4/2011 | |
| CN | 102312719 | A * | 1/2012 | F02D 41/0025 |
| CN | 102936521 | B * | 2/2013 | |
| CN | 102312719 | B * | 8/2013 | F02D 13/0203 |
| EP | 2592248 | A1 | 5/2013 | |
| JP | 3660357 | B2 * | 6/2005 | C10L 10/04 |
| JP | 3796355 | B2 * | 7/2006 | C10L 10/10 |
| WO | 2008071628 | A1 | 6/2008 | |
| WO | 2013159695 | A1 | 10/2013 | |

OTHER PUBLICATIONS

Machine Translation of CN-1405281-A (Year: 2003).*
Machine Translation of CN-102312719-A (Year: 2012).*
Machine Translation of CN-102936521-B (Year: 2013).*
Machine Translation of JP-3796355-B2 (Year: 2006).*
Machine Translation of JP-3660357-B2 (Year: 2005).*
Machine Translation of JP3796355 (Year: 2006).*
Machine Translation of JP3660357 (Year: 2005).*
Machine Translation of CN102312719B (Year: 2013).*
Machine Translation of WO2001092442A1 (Year: 2001).*
Downs et al:"The Effects of Additives on the Octane Number and Cetane Number of Gasolines", Journal of the Institute of Petroleum, London, GB, vol. 515, No. 52, Nov. 1, 1966 (Nov. 1, 1966), pp. 331-346, XP002075889, ISSN: 0020-3068 *tables I, V, VI, VIII*.
WO2016070831A1, WO Search Report, dated May 12, 2016, Xiangjin, Zhou, the whole document.
EP15857459A1, EP Search Report, dated May 4, 2018, Xiangjin, Zhou, the whole document.
Stephen Ciatti and Swaminathan Subramanian Center for Transportation Research, An Experimental Investigation of Low Octane Gasoline in Diesel Engines, DEER 2010 Dearborn, MI Sep. 29, 2010.
Steve Przesmitzki, Aramco's research report Compression Ignition Technology of Gasoline, Sep. 18, 2015.

(Continued)

*Primary Examiner* — Ellen M McAvoy
*Assistant Examiner* — Ming Cheung Po
(74) *Attorney, Agent, or Firm* — IPro, PLLC

(57) ABSTRACT

Provided is a gasoline product containing a combustion improver, and a method for preparing the gasoline product. The combustion improver is added to gasoline to reduce an octane number and thus an ignition point of the gasoline, so that the gasoline product can be used in a compression ignition internal combustion engine. The combustion improver-containing gasoline product is a low-octane number gasoline, and is capable of being ignited through compression by an internal combustion engine having a compression ratio in the range from 12 to 22.

22 Claims, No Drawings

(56) References Cited

OTHER PUBLICATIONS

Saudi Aramco, Mazda Motor Corporation , Saudi Aramco plays a strong role at Clean Fuels Symposium in Beijing, Jan. 18, 2018.
Mazda and the National Institute of Advanced Industrial Science and Technology (AIST), Saudi Aramco, Mazda Motor Corporation and AIST collaborate to develop the world'smost advanced engine/fuel combination, Saudi Aramco Technologies Company (a Saudi Aramco company), ), Aug. 8, 2018.
Hongqiang Yang et al.,Combustion and emission characteristics of low octane number gasoline with partially diffused compression ignition,Journal of Automotive Safety and Energy, 2011, 2(4): 330-337.

* cited by examiner

GASOLINE PRODUCT CONTAINING COMBUSTION IMPROVER AND MANUFACTURING METHOD THEREFOR

CROSS-REFERENCE TO RELATED APPLICATIONS

The present application claims the priority of Chinese patent application CN 201410614564.4, entitled "Gasoline product containing combustion improver and manufacturing method therefor" and filed on Nov. 5, 2014, the entirety of which is incorporated herein by reference.

FIELD OF THE INVENTION

The present disclosure relates to the field of petroleum refining, and in particular, to a gasoline product containing a combustion improver and a method for manufacturing the gasoline product.

BACKGROUND OF THE INVENTION

Gasoline, substantially with petroleum as a raw material, is generally a mixture of various hydrocarbons having 5 to 11 carbon atoms.

A high octane number is desired for an ordinary gasoline product, so that an internal combustion engine using the gasoline product can have a relatively high compression ratio and an improved efficiency. Existing gasoline production technologies largely seek to increase the octane number of gasoline at low costs. A most commonly used procedure is to reform the gasoline, or to add an antiknock agent into the gasoline product.

Recently, a low-octane gasoline product has been formulated with hydrocarbon raw materials of low-octane numbers, which can be used in a compression ignition low-octane gasoline engine to achieve the technical objective of significantly improving the efficiency of the gasoline engine.

SUMMARY OF THE INVENTION

A combustion improver is added to gasoline with a relatively high ignition point, to reduce the ignition point of the gasoline, so that the gasoline can be ignited through compression. Specifically, the present disclosure relates to two aspects, i.e., a method and a product.

According to a first aspect of the present disclosure, a method of adding a combustion improver into gasoline is provided, comprising: adding the combustion improver to the gasoline to reduce an ignition point and an octane number of the gasoline, so that the gasoline can be used as a fuel in a compression-ignition internal combustion engine. Gasoline that can be ignited through compression has a low-octane number, generally less than or equal to 69 (research octane number, RON).

The gasoline product containing the combustion improver can be prepared by the above method. The combustion improver can be added to the gasoline to reduce the ignition point of the gasoline, so that the gasoline product can be ignited through compression by the compression-ignition internal combustion engine. The combustion improver can be added, in response of different octane numbers of base gasoline, at controlled contents and proportions into the gasoline product, so as to achieve a homogeneous nitrogen-oxygen equivalent in the gasoline product. The combustion improver can be homogeneously mixed with base gasoline, to effectively reduce the ignition point of the gasoline. The octane number of the gasoline product is less than or equal to 69 (RON), preferably in the range from −60 to 69, and more preferably in the range from −10 to 59.

A variety of combustion improvers can be simultaneously added, and in response of different octane numbers of the base gasoline, the content and proportion of each combustion improver can be controlled in the gasoline, to achieve a homogeneous nitrogen-oxygen equivalent of the gasoline product. When a homogeneous nitrogen-oxygen equivalent of low-octane gasoline is obtained, a content of the nitrogen oxides contained in exhaust gases discharged from the internal combustion engine using such a fuel will not fluctuate due to the addition of the combustion improver to the gasoline fuel. This is advantageous for an exhaust gas treatment device (such as a three-way catalytic device) to effectively remove the nitrogen oxides from the exhaust gases.

A compound suitable to be added into the gasoline as a combustion improver generally has the following technical features: capable of being mixed homogeneously with the base gasoline and at the same time capable of effectively reducing the ignition point of the gasoline.

The above combustion improver includes but is not limited to ammonium nitrate and derivatives thereof, nitrates and derivatives thereof, aniline and derivatives thereof, and nitrobenzene and derivatives thereof.

Specific combustion improver includes but is not limited to:

ammonium nitrate and ammonium nitrite, methyl nitrate, ethyl nitrate, propyl nitrate, butyl nitrate, amyl nitrate, hexyl nitrate, heptyl nitrate, octyl nitrate, nonyl nitrate, decyl nitrate, undecyl nitrate, and dodecyl nitrate, other high-grade fatty alcohol esters of nitric acid, and various isomers of nitrates;

nitrites and derivatives thereof;

aniline, methylaniline, ethylaniline, propylaniline, and methylethylamine;

nitrobenzene, nitrotoluene and derivatives thereof, nitroethylbenzene and derivatives thereof, nitropropylbenzene and derivatives thereof, and nitromethylethylbenzene and derivatives thereof;

phenol, acetone, cyclohexanone, methyl ether, diethyl ether, methyl ethyl ether, propyl ether, methyl propyl ether, ethylpropyl ether, caprolactam, acrylonitrile, adipic acid, hexamethylene diamine, acetic acid, propionic acid, formic acid, (methanoic acid), formaldehyde, acetaldehyde, propionaldehyde, butyraldehyde, isobutyraldehyde, and benzaldehyde;

vinyl acetate, dicumyl peroxide, linalool, 1,4-butanediol, tetrahydrofuran, diethylene glycol, polyethylene glycol, ethylene glycol ether, cyclohexylamine, dicyclohexylamine, acetonitrile, hydroxy acetonitrile, and bisphenol A;

methyl acetate, ethyl acetate, propyl acetate, butyl acetate, amyl acetate, hexyl acetate, heptyl acetate, octyl acetate, nonyl acetate, decyl acetate, undecyl acetate, dodecyl acetate, and methyl acrylate;

trinitrobenzene and derivatives thereof, trinitrotoluene, trinitroethylbenzene, trinitropropylbenzene, and trinitrobutylbenzene;

dinitrobenzene and derivatives thereof, dinitrotoluene, dinitroethylbenzene, dinitropropylbenzene, and dinitrobutylbenzene;

trinitrophenol, dinitrophenol, nitrophenol, ethylene oxide, propylene oxide, and hydrazine; and all the above-mentioned compounds which can be used as combustion improvers would include isomers of such compounds with various carbon chain structures, if they have a carbon chain. For example, butyl nitrates include isobutyl nitrate, n-butyl nitrate; and octyl nitrates include n-octyl nitrate and octyl nitrates of a variety of other structures, so on and so forth.

Various combustion improvers and combinations thereof with different content ratios play different roles in the properties of gasoline and in reducing the octane number thereof. Different isomers of a combustion improver are also different in function and properties to reduce the octane number of the gasoline.

When various combustion improvers and combinations thereof are added into base gasoline of different octane numbers, reduced values in the octane numbers of the gasoline can be obtained through experiments. Alternatively, empirical formula can be acquired on an experimental basis. Through such formula, an octane number index or ignition point of the low-octane gasoline following addition of the combustion improver can be calculated.

The above empirical formula can be specifically listed as follows:

$$X=Y-(Z\div U)\times 16{,}000;$$

$$X=Y-(V\div U)\times 7000;$$

$$X=Y-(Z\div U)\times 16{,}000-(V\div U)\times 7000;\text{ and}$$

$$W=(O\times Z+P\times V)\div(U+Z+V),$$

wherein:

X is an octane number of a gasoline product;

Y is an octane number of base oil (main raw material);

Z is an addition amount of n-butyl nitrate (by weight);

U is an amount of base oil (by weight);

V is an amount of n-octyl nitrate (by weight);

W is a nitrogen-oxygen equivalent of the product;

O is a mass fraction of nitrogen atoms in n-butyl nitrate; and

P is a mass fraction of the nitrogen atoms in n-octyl nitrate.

According to a second aspect of the present disclosure, a gasoline product comprising a combustion improver is provided, wherein the gasoline product has an octane number of less than 69 and is capable of being ignited through compression by an internal combustion engine having a compression ratio in the range from 9 to 22.

In one preferred embodiment of the present disclosure, the gasoline product contains a mixture of hydrocarbons having 6 to 11, or 5 to 12 carbon atoms as main constituents, and one or two, or more than two combustion improvers. With addition of the combustion improvers, an ignition point or octane number of the gasoline is reduced, so that the gasoline is capable of being ignited through compression by an internal combustion engine having a compression ratio in the range from 12 to 22, or 9 to 12.

As an expansion of the gasoline product containing a combustion improver, the number of carbon atoms in the hydrocarbon as a gasoline feedstock can be increased. That is, the gasoline product contains a mixture of hydrocarbons having 5 to 12 carbon atoms as main constituents, and meanwhile contains 0 to 10% by mass of a mixture of hydrocarbons having 13 to 19 carbon atoms, or 10 to 30% by mass of a mixture of hydrocarbons having 13 to 19 carbon atoms, or 30 to 70% by mass of a mixture of hydrocarbons having 13 to 19 carbon atoms. In practice, low-octane gasoline containing the combustion improver can be blended into diesel oil and used in a diesel engine. Diesel oil mixed with low-octane gasoline containing the combustion improver leads to three aspects of the advantages, i.e., reduced smoke emissions of the diesel engine; improved fuel efficiency; and improved anti-freezing performance of the diesel oil.

Further, a biomass fuel can be used as base gasoline for the gasoline product containing the combustion improver, or the main constituents of the base gasoline can be from biomass materials; or the main constituents of the gasoline are a mixture of heteroatom-containing hydrocarbons having 4 to 12 carbon atoms. The biomass low-octane gasoline containing the combustion improver can also be blended with ordinary diesel oil (with oil or other fossil fuels as a raw material) or biomass diesel oil, and used in a diesel engine. Similarly, the low-octane gasoline which contains the combustion improver and uses the base gasoline obtained from oil refining gas the raw material may also be blended into biomass diesel oil and then used in a diesel engine.

In other words, with respect to the gasoline product containing the combustion improver, the main constituents of the gasoline are from biomass materials; or the main constituents of the gasoline are a mixture of heteroatom-containing hydrocarbons having 4 to 19 carbon atoms, among which a mass fraction of heteroatom-containing hydrocarbons having 13 to 19 carbon atoms ranges from 0 to 10%; or a mass fraction of heteroatom-containing hydrocarbons having 13 to 19 carbon atoms ranges from 10 to 30%; or a mass fraction of heteroatom-containing hydrocarbons having 13 to 19 carbon atoms ranges from 30 to 70%.

The technical problem solved by the present disclosure is that the base gasoline has too high an ignition point to be ignited through compression by an internal combustion engine having a specific compression ratio. The combustion improver is added to reduce the ignition point of the gasoline, which can thus be stably and reliably ignited through compression by the internal combustion engine having a specific compression ratio. Moreover, after the combustion improver is added, the low-octane gasoline has a homogeneous and controllable nitrogen-oxygen equivalent content.

The present disclosure is effective and significant in that: thermal conversion efficiency of a compression ignition internal combustion engine is 30% higher than that of an ignition internal combustion engine, and the present disclosure provides a low-cost method for converting gasoline unsuitable to be used as a compression ignition fuel into efficient low-octane gasoline, and meanwhile obtains a new gasoline product containing the combustion improver.

A combustion improver mixture of two or more combustion improvers is advantageous in reducing toxicity and purifying emissions, such that the content of nitrogen-oxygen in the gasoline can be homogeneous, and the composition of nitrogen oxides in the emissions tend to be homogenous. This facilitates operations of the three-way catalytic device. In the future, an index of nitrogen-oxygen equivalent may be added to a gasoline product standard list.

Compared with a gasoline antiknock agent, the gasoline combustion improver contains no metal, causes less air pollution, and brings about fewer damages to the environment. Users and manufacturers should try to choose combustion improvers which are free of or have low toxicity.

The following notes can be referred to for some terms used in the present disclosure.

Base gasoline refers to feedstock gasoline which has a relatively high octane number and is to be added with the combustion improver. The base gasoline itself may also have a low octane number (less than or equal to 69), and can have a further reduced ignition point by being added with the combustion improver.

A nitrogen-oxygen equivalent content (referred to as "nitrogen-oxygen equivalent") refers to the content of nitrogen oxides added in the exhaust gases due to addition of the combustion improver to the gasoline product. As this content is difficult to determine, in the present disclosure, the mass of the nitrogen atoms contained per unit mass of the gasoline product is regarded as the nitrogen-oxygen equivalent content. For example, if the mass of the nitrogen atoms is 0.02 gram in per kilogram of the low-octane gasoline containing the combustion improver, then the nitrogen-oxygen equivalent of the gasoline is 20 mg/kg (20 ppm). This nitrogen-oxygen equivalent is different from a nitrogen oxide content in vehicle exhaust. They are two different concepts. During a combustion procedure of the gasoline added with the combustion improver, most of the nitrogen atoms in the combustion improver are converted into nitrogen and discharged as an exhaust gas, while a small amount of the nitrogen atoms will be converted into nitrogen atoms in the nitrogen oxides. Gasoline products added with different types or different levels of combustion improvers usually have different, or even significantly different nitrogen-oxygen equivalent contents. When the gasoline products with different nitrogen-oxygen equivalent contents are used, the content of nitrogen oxides in the exhaust gases discharged from the internal combustion engine will fluctuate, which is disadvantageous for effective removal of the nitrogen oxides, hydrocarbons, and carbon monoxide from the exhaust gases by an exhaust gas treatment device (for example, a three-way catalytic device).

Hydrocarbons having 5 to 12 carbon atoms represent a mixture of eight hydrocarbons having 5, 6, 7, 8, 9, 10, 11, and 12 carbon atoms, respectively. Different types of hydrocarbons, due to different carbon chain structures and different hydrogen contents, have different molecular weights. A same molecular formula having the same molecular weight can represent several different isomers.

Biomass raw materials refer to grease raw materials originated from plants or algae, and can be used to manufacture gasoline fuels.

Hetero atoms refer to atoms other than carbon atoms and hydrogen atoms, usually including but not limited to nitrogen atoms, oxygen atoms, sulfur atoms, and the like.

Heteroatom-containing hydrocarbons have similar definitions to the above "hydrocarbons" except that a nitrogen atom or an oxygen atom is added to the carbon chain. Hydrocarbons containing other hetero atoms, such as sulfur atoms, halogen atoms (including fluorine, chlorine, and bromine), are undesirable as gasoline feedstocks. Combustion improvers containing sulfur atoms or halogen atoms are also undesirable.

The combustion improver in the present disclosure can also be a mixture with a combustion improver as its main component. For example, aniline may be an aniline-based mixture or semi-finished product.

Hydrazine is added appropriately after being mixed with an organic solvent, for example, in the form of a hydrazine solution with gasoline as a solvent. In general, hydrazine is only suitable as a gasoline combustion improver on special conditions.

DETAILED DESCRIPTION OF THE EMBODIMENTS

Example 1

Base gasoline having an octane number of 70 was added with a combustion improver n-butyl nitrate at a mass fraction of A, to obtain low-octane gasoline with an octane number of 30. Base gasoline having an octane number of 63 was added with the combustion improver n-butyl nitrate at a mass fraction B and a combustion improver n-octyl nitrate at a mass fraction C simultaneously, to obtain low-octane gasoline with an octane number of 30 also. Moreover, the low-octane gasoline products obtained through the above two approaches had the same octane number (30), and contained the same amount of nitrogen atoms (by mass) per unit mass of gasoline, i.e., the same nitrogen-oxygen equivalent.

Example 2

Naphtha (or straight-run gasoline) which was obtained from petroleum refining and had an octane number of 68 was used as a raw material (base gasoline), into which n-butyl nitrate having a mass fraction of 0.08% was added to obtain low-octane gasoline with an octane number of 55.

Example 3

Light oil with biomass oil as a raw material and having an octane number of 60 was added with ammonium nitrate at a mass fraction of E and nitro benzene in a mass fraction of F, to obtain low-octane gasoline with an octane number of 25.

Example 4

A specific by-product, chemical light oil, which was obtained from a petrochemical plant and had an octane number of 59 and a density of 0.68 g/cm3 was used as a raw material and added with a combustion improver, to obtain low-octane gasoline with an octane number of 20. Such low-octane gasoline was homogeneously blended with No. 0 diesel oil at a mass ratio of 50%. A resulting blended fuel could be used successfully in a diesel engine. Such a blended fuel had better power performance and generated cleaner exhaust gases than diesel oil. Moreover, such a blended fuel had anti-freeze resistance and would not be frozen at minus 20° C.

Example 5

Gasoline 93 #sold at gas stations (being commercially available) having an octane number of 93 was used as a raw material and added with a combustion improver to obtain low-octane gasoline having an octane number of (−10)-69, or other labels of gasoline products with an octane number in the range from 69 to 92.

The invention claimed is:

1. A method for preparing a gasoline product containing a combustion improver, comprising:

adding the combustion improver to gasoline to reduce an octane number of the gasoline, so that the gasoline can be ignited through compression by a compression-ignition internal combustion engine;

wherein the combustion improver can be homogeneously mixed with the base gasoline, to effectively reduce the octane number of the gasoline;

wherein the gasoline product consists of gasoline and the combustion improver;

the said combustion improver is an additive having the ability to reduce the octane number of gasoline, or a combination of two or more additives having the ability to reduce the octane number of gasoline;

wherein the gasoline contains a mixture of hydrocarbons having each 6 to 11, or 5 to 12 carbon atoms as main constituents;

wherein the combustion improver comprises at least one selected from a group consisting of ammonium nitrate and derivatives thereof, nitrates and derivatives thereof, aniline and derivatives thereof, and nitrobenzene and derivatives thereof;

wherein the nitrates and derivatives thereof are at least one selected from a group consisting of methyl nitrate, ethyl nitrate, propyl nitrate, butyl nitrate, amyl nitrate, hexyl nitrate, heptyl nitrate, nonyl nitrate, decyl nitrate, undecyl nitrate, dodecyl nitrate, and nitrites and derivatives thereof;

wherein the gasoline product has an octane number of less than or equal to 69 and is capable of being ignited through compression ignition by an internal combustion engine having a compression ratio in the range from 9 to 22.

2. The method according to claim 1, wherein the combustion improver further comprises at least one selected from a group consisting of phenol, acetone, cyclohexanone, methyl ether, diethyl ether, methyl ethyl ether, propyl ether, methyl propyl ether, ethyl propyl ether, caprolactam, acrylonitrile, adipic acid, hexamethylene diamine, acetic acid, propionic acid, formic acid, formaldehyde, acetaldehyde, propionaldehyde, butyraldehyde, isobutyraldehyde, benzaldehyde, vinyl acetate, dicumyl peroxide, linalool, 1,4-butanediol, tetrahydrofuran, diethylene glycol, polyethylene glycol, ethylene glycol ether, cyclohexylamine, dicyclohexylamine, acetonitrile, hydroxy acetonitrile, bisphenol A, methyl acetate, ethyl acetate, propyl acetate, butyl acetate, amyl acetate, hexyl acetate, heptyl acetate, octyl acetate, nonyl acetate, decyl acetate, undecyl acetate, dodecyl acetate, methyl acrylate, ethylene oxide, propylene oxide, and hydrazine.

3. The gasoline product according to claim 1, wherein the gasoline contains a mixture of claim 1 as main constituents, and meanwhile contains 0 to 70% by mass of a mixture of hydrocarbons having each 13 to 19 carbon atoms.

4. The gasoline product according to claim 1, wherein the main constituents of the gasoline are from biomass materials; or wherein the main constituents of the gasoline are a mixture of heteroatom-containing hydrocarbons having 4 to 12 carbon atoms.

5. The gasoline product according to claim 1, wherein the main constituents of the gasoline are from biomass materials; or wherein the main constituents of the gasoline are a mixture of heteroatom-containing hydrocarbons having 4 to 19 carbon atoms, among which a mass fraction of heteroatom-containing hydrocarbons having 13 to 19 carbon atoms ranges from 0 to 70%.

6. The method according to claim 1, wherein the ammonium nitrate and derivatives thereof are at least one selected from a group consisting of ammonium nitrate and ammonium nitrite.

7. The method according to claim 1, wherein the aniline and derivatives thereof are at least one selected from a group consisting of aniline, methylaniline, ethylaniline, propylaniline, and methylethylaniline.

8. The method according to claim 1, wherein the nitrobenzene and derivatives thereof are at least one selected from a group consisting of nitrobenzene, nitrotoluene and derivatives thereof, nitroethylbenzene and derivatives thereof, nitropropyl benzene and derivatives thereof, nitromethylethylbenzene and derivatives thereof, dinitrobenzene and derivatives thereof, and trinitrobenzene and derivatives thereof.

9. The method according to claim 1, wherein the nitrobenzene and derivatives thereof are at least one selected from a group consisting of trinitrotoluene, trinitroethylbenzene, trinitropropylbenzene, trinitrobutylbenzene, dinitrotoluene, dinitroethylbenzene, dinitropropylbenzene, dinitrobutylbenzene, trinitrophenol, dinitrophenol, and nitrophenol.

10. A gasoline product prepared by the method according to claim 1, wherein the gasoline product has an octane number of less than or equal to 69 and is capable of being ignited through compression ignition by an internal combustion engine having a compression ratio in the range from 9 to 22.

11. The gasoline product according to claim 10, wherein the gasoline product has an octane number of less than or equal to 69 and is capable of being ignited through compression ignition by an internal combustion engine having a compression ratio in the range from 9 to 22;

wherein the combustion improver further comprises at least one selected from a group consisting of phenol, acetone, cyclohexanone, methyl ether, diethyl ether, methyl ethyl ether, propyl ether, methyl propyl ether, ethyl propyl ether, caprolactam, acrylonitrile, adipic acid, hexamethylene diamine, acetic acid, propionic acid, formic acid, formaldehyde, acetaldehyde, propionaldehyde, butyraldehyde, isobutyraldehyde, benzaldehyde, vinyl acetate, dicumyl peroxide, linalool, 1,4-butanediol, tetrahydrofuran, diethylene glycol, polyethylene glycol, ethylene glycol ether, cyclohexylamine, dicyclohexylamine, acetonitrile, hydroxy acetonitrile, bisphenol A, methyl acetate, ethyl acetate, propyl acetate, butyl acetate, amyl acetate, hexyl acetate, heptyl acetate, octyl acetate, nonyl acetate, decyl acetate, undecyl acetate, dodecyl acetate, methyl acrylate, ethylene oxide, propylene oxide, and hydrazine.

12. The method according to claim 1, wherein adding the combustion improver at controlled contents and proportions into the gasoline, in response of different octane numbers of base gasoline, to achieve a homogeneous nitrogen-oxygen equivalent of the gasoline product.

13. The gasoline product according to claim 1, wherein the gasoline contains a mixture of hydrocarbons having 5 carbon atoms as main constituents.

14. A method for preparing a gasoline product containing a combustion improver, comprising:

adding the combustion improver to gasoline to reduce an octane number of the gasoline, so that the gasoline can be ignited through compression by a compression-ignition internal combustion engine;

wherein the combustion improver can be homogeneously mixed with the base gasoline, to effectively reduce the octane number of the gasoline;

wherein the gasoline product consists of gasoline and the combustion improver;

the said combustion improver is an additive having the ability to reduce the octane number of gasoline, or a combination of two or more additives having the ability to reduce the octane number of gasoline;

wherein the gasoline contains a mixture of hydrocarbons having each 6 to 11, or 5 to 12 carbon atoms as main constituents;

wherein the gasoline product has an octane number of less than or equal to 69 and is capable of being ignited through compression ignition by an internal combustion engine having a compression ratio in the range from 9 to 22.

15. The method according to claim 14, wherein the combustion improver further comprises at least one selected from a group consisting of nitrates and derivatives thereof, aniline and derivatives thereof, and nitrobenzene and derivatives thereof.

16. The method according to claim 15, wherein the nitrates and derivatives thereof are at least one selected from a group consisting of methyl nitrate, ethyl nitrate, propyl nitrate, butyl nitrate, amyl nitrate, hexyl nitrate, heptyl nitrate, octyl nitrate, nonyl nitrate, decyl nitrate, undecyl nitrate, dodecyl nitrate, and nitrites and derivatives thereof;

wherein the aniline and derivatives thereof are at least one selected from a group consisting of aniline, methylaniline, ethylaniline, propylaniline, and methylethylaniline;

wherein the nitrobenzene and derivatives thereof are at least one selected from a group consisting of nitrobenzene, nitrotoluene and derivatives thereof, nitroethylbenzene and derivatives thereof, nitropropyl benzene and derivatives thereof, nitromethylethylbenzene and derivatives thereof, dinitrobenzene and derivatives thereof, and trinitrobenzene and derivatives thereof.

17. The method according to claim 14, wherein the ammonium nitrate and derivatives thereof are at least one selected from a group consisting of ammonium nitrate and ammonium nitrite.

18. The method according to claim 14, wherein the combustion improver further comprises at least one selected from a group consisting of phenol, acetone, cyclohexanone, methyl ether, diethyl ether, methyl ethyl ether, propyl ether, methyl propyl ether, ethyl propyl ether, caprolactam, acrylonitrile, adipic acid, hexamethylene diamine, acetic acid, propionic acid, formic acid, formaldehyde, acetaldehyde, propionaldehyde, butyraldehyde, isobutyraldehyde, benzaldehyde, vinyl acetate, dicumyl peroxide, linalool, 1,4-butanediol, tetrahydrofuran, diethylene glycol, polyethylene glycol, ethylene glycol ether, cyclohexylamine, dicyclohexylamine, acetonitrile, hydroxy acetonitrile, bisphenol A, methyl acetate, ethyl acetate, propyl acetate, butyl acetate, amyl acetate, hexyl acetate, heptyl acetate, octyl acetate, nonyl acetate, decyl acetate, undecyl acetate, dodecyl acetate, methyl acrylate, ethylene oxide, propylene oxide, and hydrazine.

19. The method according to claim 15, wherein the nitrobenzene and derivatives thereof are at least one selected from a group consisting of trinitrotoluene, trinitroethylbenzene, trinitropropylbenzene, trinitrobutylbenzene, dinitrotoluene, dinitroethylbenzene, dinitropropylbenzene, dinitrobutylbenzene, trinitrophenol, dinitrophenol, and nitrophenol.

20. The method according to claim 14, wherein adding the combustion improver at controlled contents and proportions into the gasoline, in response of different octane numbers of base gasoline, to achieve a homogeneous nitrogen-oxygen equivalent of the gasoline product.

21. A gasoline product prepared by the method according to claim 14, wherein the gasoline product has an octane number of less than or equal to 69 and is capable of being ignited through compression ignition by an internal combustion engine having a compression ratio in the range from 9 to 22.

22. The method according to claim 14, wherein the gasoline contains a mixture of hydrocarbons having 5 carbon atoms as main constituents.

* * * * *